US006045127A

United States Patent [19]

Fukui

[11] Patent Number: 6,045,127

[45] Date of Patent: Apr. 4, 2000

[54] EJECTED PAPER SORTING DEVICE AND ITS USE IN IMAGE RECORDING APPARATUS

[75] Inventor: Isao Fukui, Kyoto, Japan

[73] Assignee: Murata Kikai Kabushiki Kaisha, Kyoto, Japan

[21] Appl. No.: 08/838,785

[22] Filed: Apr. 10, 1997

[30] Foreign Application Priority Data

Apr. 12, 1996 [JP] Japan ..... 8-091108

[51] Int. Cl.[7] ..... B65H 39/10; B65H 29/00

[52] U.S. Cl. ..... 271/303; 271/305; 271/184; 271/292; 271/297

[58] Field of Search ..... 271/184, 3.03, 271/3.04, 290, 292, 297, 303, 213; 414/791.5, 791.2

[56] References Cited

U.S. PATENT DOCUMENTS

| | | | |
|---|---|---|---|
| 3,795,395 | 3/1974 | Ransom et al. | 271/4.06 |
| 3,831,929 | 8/1974 | Hellmer | 271/303 |
| 4,015,842 | 4/1977 | Perry | 271/207 |
| 4,553,831 | 11/1985 | Dixon | 355/26 |
| 4,570,922 | 2/1986 | Akers | 271/178 |
| 5,618,035 | 4/1997 | Coombs et al. | 271/213 |
| 5,704,609 | 1/1998 | Mandel et al. | 271/290 |
| 5,953,574 | 9/1999 | Okada | 399/374 |

*Primary Examiner*—Donald P. Walsh
*Assistant Examiner*—Daniel K. Schlak
*Attorney, Agent, or Firm*—Armstrong, Westerman, Hattori, McLeland & Naughton

[57] ABSTRACT

A paper sorting device is incorporated in a recording machine. The paper sorting device includes a first paper tray located near a recording paper exit of the recording machine and a second paper tray located below the first paper tray. A flap is provided as a part of the first paper tray such that it can move to form an opening for passing of the recording paper therethrough. A drive mechanism is also provided for maintaining the flap in position or moving the flap to form the opening. When the flap is maintained in position, the recording paper is ejected onto the first paper tray. When the flap is moved, the recording paper falls onto the second tray through the opening made by the moved flap. Therefore, two kinds of recording paper are separately collected in the two paper trays respectively. The flap may be hinge-linked to the first paper tray so that it can rotate about its hinge upwards and downwards. If the recording machine is an image recording machine having a facsimile function and a copy function, the recording paper as a result of facsimile data reception from a remote facsimile may be ejected onto the first paper tray and the recording paper as a result of copying may be ejected onto the second paper tray.

13 Claims, 6 Drawing Sheets

EJECTED PAPER SORTING DEVICE AND ITS USE IN IMAGE RECORDING APPARATUS

BACKGROUND OF THE INVENTION

1. Technical Field

The present invention generally relates to a device for sorting paper ejected, and more particularly to an ejected paper sorting device for sorting and ejecting paper to a plurality of levels depending on the contents recorded on the paper ejected. The present invention also concerns to an image recording apparatus provided with copy and facsimile functions utilizing such a paper sorting device.

2. Background Art

Image recording apparatuses provided with copy functions and facsimile functions are known in the art and some of such apparatuses are also equipped with an ejected paper sorting device that allows a compact design by having only one path way for ejected paper and is able to sort the recorded paper to be ejected into that which has been recorded as a result of facsimile reception and that which has been recorded as a result of copying.

Conventional ejected paper sorting devices sort the ejected paper by providing a single paper tray having a plurality of sections for reception of various kinds of ejected paper and adjusting the position of the paper tray horizontally to receive the ejected paper in the most appropriate section or by providing a plurality of levels of paper ejection trays and moving the stack of trays vertically to receive the ejected paper in the most appropriate level of tray or by providing a plurality of trays arranged next to each other in a single plane and advancing a necessary tray to catch the ejected paper or retracting unnecessary trays to leave the necessary tray for reception of the ejected paper. However, all of them require a system for moving the paper ejection tray(s). This makes the device complicated and raises a manufacturing cost.

SUMMARY OF THE INVENTION

It is an object of the present invention to propose an improved ejected paper sorting device which can solve the above described problems present on conventional ejected paper sorting devices.

Another object of the present invention is to provide an image recording machine equipped with such a paper sorting device.

According to one aspect of the present invention, there is provided a paper sorting device incorporated in a recording machine comprising a first paper tray located near a recording paper exit of the recording machine, a second paper tray located below the first paper tray, a flap which is a part of the first paper tray and which is able to move to form an opening or free space for passing of the recording paper therethrough and means for maintaining the flap in position or moving the flap to form the opening. When the flap is maintained in position, the recording paper is ejected onto the first paper tray. When the flap is moved, the recording paper falls onto the second tray through the opening made by the moved flap. Therefore, two kinds of recording paper are collected in the separate paper trays. The flap may be hinge-linked to the first paper tray so that it can rotate about the hinge upwards and downwards. Upon upward movement of the flap, the opening is formed in the first paper tray so that the recording paper is received in the second paper tray. Upon downward movement, the flap closes the opening so that the recording paper is received in the first paper tray. The flap may be made from a light-weight material so that a drive mechanism for the flap needs a relatively small power.

If the recording machine is an image recording machine having a facsimile function and a copy function, the recording paper as a result of facsimile data reception from a remote facsimile may be ejected onto the first paper tray and the recording paper as a result of copying may be ejected onto the second paper tray, or vice versa. The recording machine may be provided with means for determining an operation mode of the recording machine and the flap is maintained in position or moved to form the opening depending upon the determined operation mode of the recording machine, i.e., facsimile mode or copy mode.

A third paper tray may be provided below the second paper tray so that three kinds of recording paper can be separated in the respective paper trays. In this case, the second paper tray may include a second flap so that the recording paper is ejected into the first tray when the first and second flaps are closed or when the first flap is closed and the second flap is opened, into the second tray when the first flap is opened and the second flap is closed, and into the third tray when the first and second flaps are both opened.

A fourth, fifth, . . . trays may also be provided below the third tray so that four or more kinds of recording papers are appropriately grouped by the suitable trays.

If there are only two paper trays, then the lower tray may have a plurality of sections thereon. By sliding the lower tray horizontally, different sections on the lower tray may be used for reception of different kinds of recording paper. In this case, paper trays are two, but grouping of the recording paper into more than two is possible.

The third paper tray may be provided between the first and second paper trays.

DETAILED DESCRIPTION OF THE PREFERRED EMBODIMENTS

Hereafter, preferred embodiments of the present invention will be described with reference to the accompanying drawings.

Firstly, the structure of the ejected paper sorting device of the present invention will be described by referring to FIGS. 2 through 5. A pair of paper ejection rollers 6 and 7 is positioned in the paper ejection part and recorded paper is ejected from between the paper ejection rollers 6 and 7. The large arrows in FIGS. 2 through 5 show the direction of movement of the recorded paper PP. As best seen in FIG. 3, the starting edge (right edge in FIG. 3) of an upper paper ejection tray 1 is positioned slightly below the recording paper exit of a recording machine defined by the paper ejection rollers 6 and 7 so that the recording paper is appropriately loaded onto the upper paper tray 1 as indicated by the shaded arrows. A lower paper ejection tray 5 is positioned slightly below the upper paper tray 1.

Figure 2:
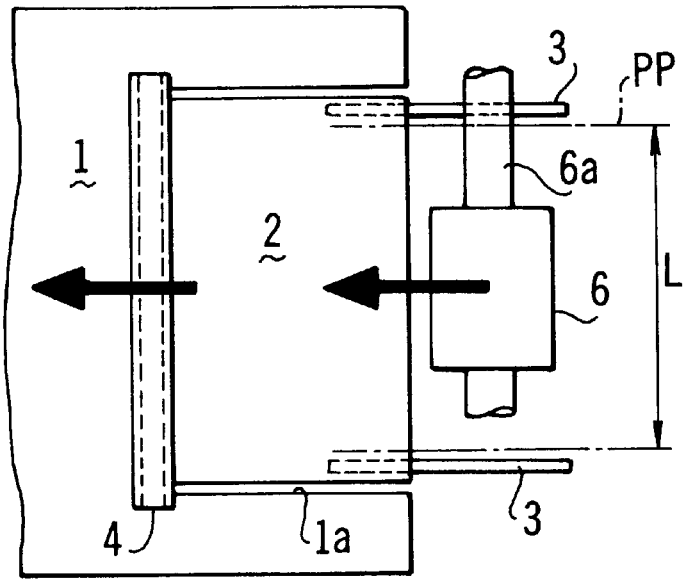
FIG. 2 is a plan view of the ejected paper sorting device shown in FIG. 1 when paper is ejected to an upper tray.
Figure 3:
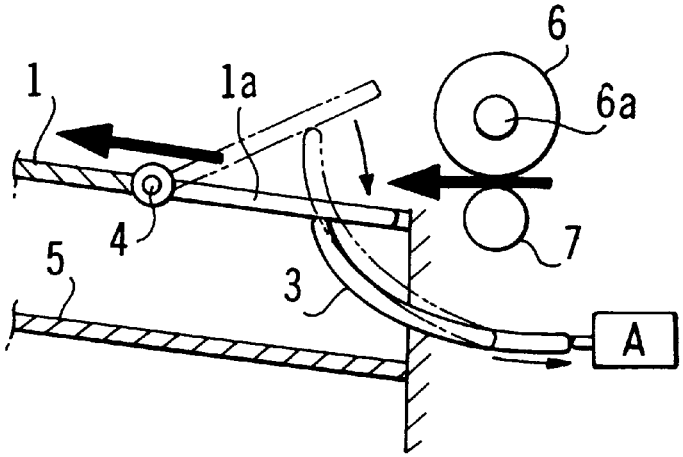
FIG. 3 is a side sectional view of the ejected paper sorting device shown in FIG. 2.

As understood from FIG. 2, both the upper paper tray 1 and lower paper tray 5 or at least the upper paper tray 1 is wider than the maximum width L of the moved recording paper PP. A rectangular cutout or opening la is formed in a right end position of the upper tray 1, that is the side (paper ejection side) closest to the paper ejection rollers 6 and 7. The width of the cutout la is slightly wider than the maximum width L of the recording paper PP.

Figure 4:
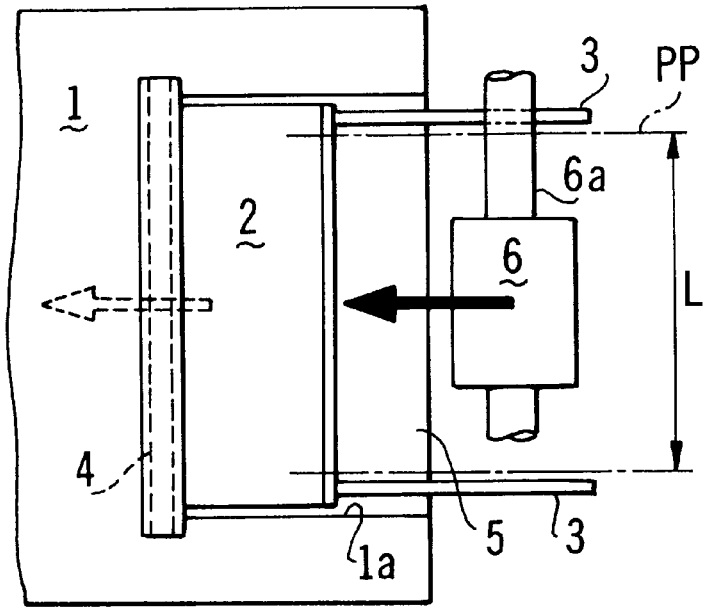
FIG. 4 is a plan view of the ejected paper sorting device shown in FIG. 1 when the recording paper is ejected to a lower tray.
Figure 5:
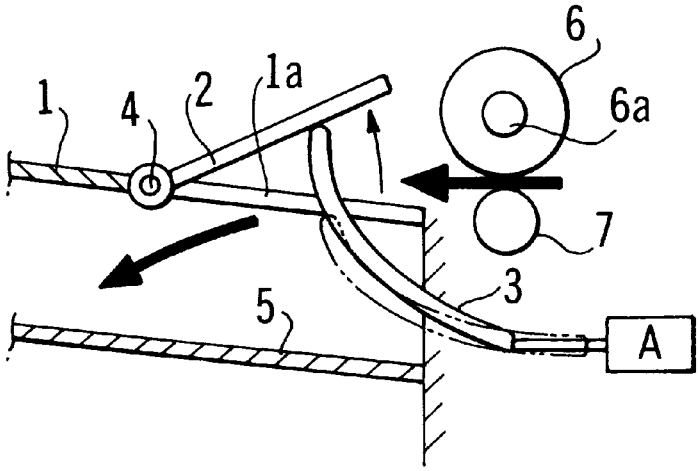
FIG. 5 is a side sectional view of the ejected paper sorting device shown in FIG. 4.

A hinge 4 is arranged in the width direction of the upper tray 1 along the edge of the cutout 1*a*. A flap or auxiliary tray 2 is mounted on this hinge 4 and can rotate upwards and downwards about the hinge 4 as a pivot. In short, the upper paper ejection tray 1 is the main tray that supports the flap 2 which is able to open and close freely. When the recording paper is to be ejected into the upper paper ejection tray 1, the cutout or opening 1*a* is closed by the flap 2 by rotating the flap 2 downwards as shown in FIGS. 2 and 3. If the opening 1*a* of the upper paper ejection tray 1 is opened by rotating the flap 2 upwards as shown in FIGS. 4 and 5, the recording paper drops downwards through the opening 1*a* and is ejected into the lower paper ejection tray 5 as indicated by the shaded arrows. The width of the opening 1*a* is larger than the maximum width L of the recording paper as previously described so there is no interference or obstruction by the upper paper ejection tray 1 when the recording paper passes through the free space 1*a*. Furthermore, the width of the opening 1*a* is only slightly larger than the width L of the paper PP such that two lateral edges of the opening a1 function as guides of the recording paper passing through the opening 1*a*. The flap 2 may be made from a light-weight material so that a drive mechanism for the flap 2 requires a relative small power.

As understood from the above, the ejected paper sorting device shown in FIGS. 2 through 5 comprises two levels; the upper paper ejection tray 1 and the lower paper ejection tray 5. Accordingly, recording paper may be sorted into two types by selective ejection of paper into the paper ejection trays 1 and 5.

Figure 6:
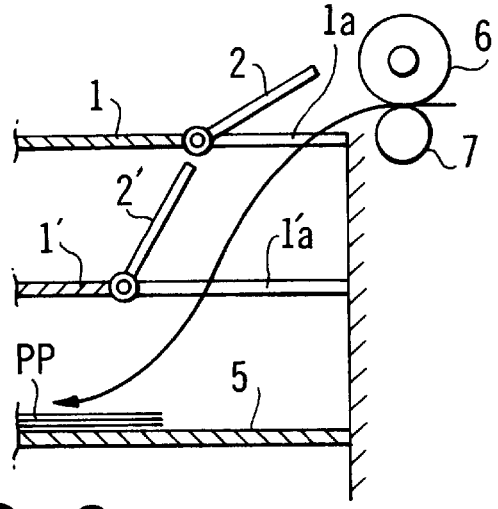
FIG. 6 is a side sectional view of another ejected paper sorting device according to the present invention when a third intermediate paper tray is provided between upper and lower trays.

FIG. 6 illustrates a modification of the paper sorting device according to the invention.

In the embodiment shown in FIG. 6, a middle paper ejection tray 1' having a second flap 2' similar to the upper paper ejection tray 1 having the first flap 2 is arranged between the upper paper ejection tray 1 and the lower paper ejection tray 5. This device has a total of three paper ejection trays allowing recording paper to be sorted into three different types. An example of ejection into the lower paper ejection tray 5 is shown in FIG. 6 with the opening 1*a* of the upper paper tray 1 and the second opening 1*a'* of the middle tray 1' being opened by rotating both the first flap 2 of the upper paper tray 1 and the second flap 2' of the middle paper tray 1'. The recording paper PP ejected by the ejection rollers 6 and 7 is guided into the lower paper tray 5. When ejection into the middle paper tray 1' is carried out, the second flap 2' of the middle paper tray 1' closes and only the first flap 2 of the upper paper tray 1 need be left open.

Figure 7:
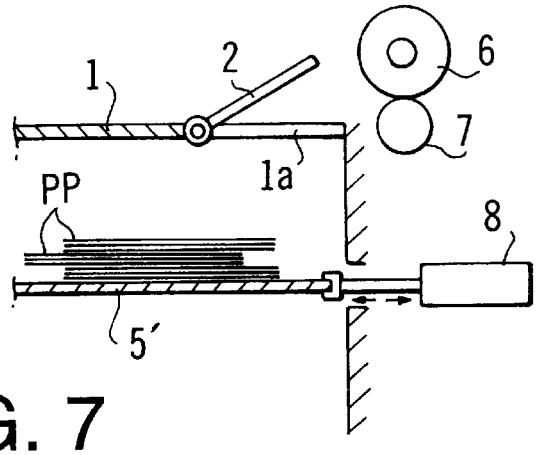
FIG. 7 is a side sectional view of another ejected paper sorting device of the present invention when the lower paper tray is able to slide horizontally.

FIG. 7 illustrates another modification. The ejected paper sorting device shown in FIG. 7 includes two levels; an upper paper tray 1 and a lower paper tray 5' like the first embodiment depicted in FIGS. 2 to 4. However, the lower paper tray 5' of this modification can alter its position in the horizontal direction by an actuator 8 such as a compressed air cylinder or electromagnetic solenoid or the like. When the recording paper is to be dropped into the lower paper tray 5' by opening the flap 2 of the upper paper tray 1, the landing and accumulation position of the recording paper PP on the lower paper tray 5' is determined by positioning the lower paper tray 5' at a certain position by the actuator 8 and sorting may be performed by the shift in this paper accumulation position. In short, there are only two levels of paper ejection trays but the recording paper PP may be sorted into three or more different types by the shifting of the position of the lower paper ejection tray 5'.

Referring back to FIGS. 2 to 5, the open-close structure of the flap 2 will be described. A pair of parallel open-close arms 3 is arranged as members for opening and closing the flap 2. As best illustrated in FIG. 2, the open-close arms 3 extend along two lateral sides of the paper PP in the plan view. The spacing between the arms 3 and 3 is slightly larger than the maximum width L of the recording paper PP such that the arms do not interfere with the recording paper.

As shown in FIGS. 3 and 5, the front end of each of the open-close arms 3 and 3 is only in contact with a lower surface of the flap 2 and is not attached to it. Accordingly, the position of each open-close arm 3 with respect to the flap 2 can change. It should be noted that the flap 2 may have grooves in its lower surface and the front ends of the arms 3 may loosely fit in the grooves.

As shown in FIGS. 3 and 5, the open-close arms 3 are driven by the other ends (the ends opposite the end which is in contact with the flap 2) being pushed or pulled by associated actuators A (for example, hydraulic or pneumatic cylinders or electromagnetic solenoids etc.) which extend or retract. The flap 2 opens or closes by this action.

Figure 8:
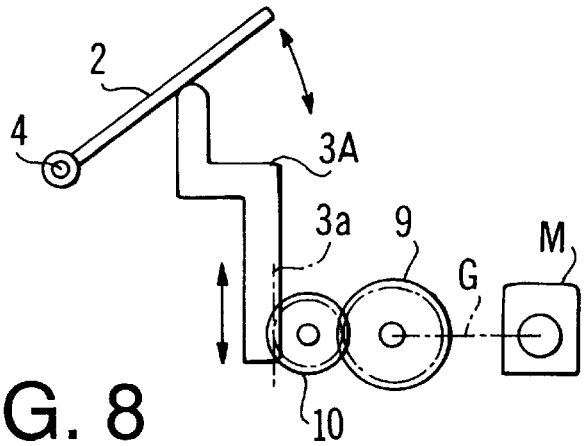
FIG. 8 illustrates a schematic side view of a drive mechanism for moving a flap of the upper tray when the flap is raised by an arm.
Figure 9:
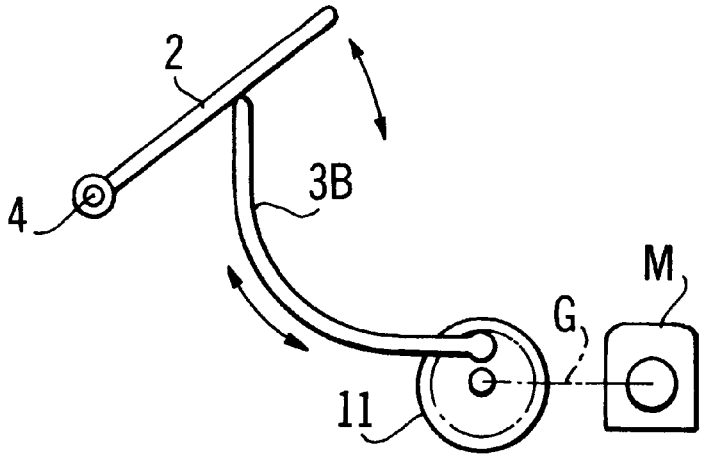
FIG. 9 illustrates a modification of the drive mechanism for moving the upper tray flap.

FIGS. 8 and 9 illustrate other mechanisms for moving the arms. As shown in FIGS. 8 and 9, a series of gears G is arranged from a motor M to each of the arms 3A and 3B as the open-close drive mechanism for these arms. In the example shown in FIG. 8, a pinion 10 engages with a drive gear 9 that is driven via a series of gears G by the motor M and that pinion 10 engages with a rack 3*a* arranged on each open-close arm 3A. Accordingly, each open-close arm 3A moves straight up or down as shown by the arrow via the rack and pinion as a result of the driving of the motor M and due to this, the flap 2 pivots upwards or downwards. In the example shown in FIG. 9, a gear 11 is arranged at the end of a series of gears G and one end of each open-close arm 3B is attached to the side of the gear 11 at an off-center position. The other end contacts the lower surface of the flap 2. In this example, each of the open-close arms 3B swivels as shown by the arrow and rotates the flap 2 upwards and downwards in association with the rotation of the gear 11 driven by the motor M.

Figure 10:
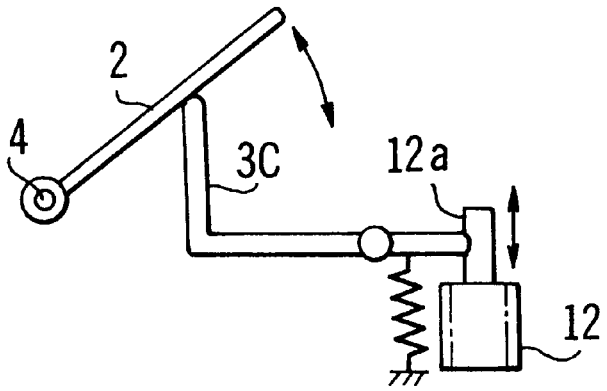
FIG. 10 depicts another modification of the drive mechanism for moving the upper tray flap, which employs an electromagnetic solenoid.

FIG. 10 also illustrates another mechanism for moving the arms up and down. Each open-close arm 3C is linked to a retractable solenoid part 12*a* of an electromagnetic solenoid 12. Due to vertical extension and retraction of the electromagnetic solenoid part 12*a,* the associated open-close arm 3C moves straight upwards and downwards and in turn causes the flap 2 to rotate clockwise and counterclockwise as indicated by the double arrow. A switch for detecting change of an operation mode from a first mode to a second mode (e.g., a facsimile mode to a copy mode) (not shown) is used as a switch for energizing and deenergizing the solenoid 12. The switch changes the stop position of the solenoid 12*a* each time the switch is pressed once. A press button such as that used in a ball pen may be used as this switch.

Figure 11:
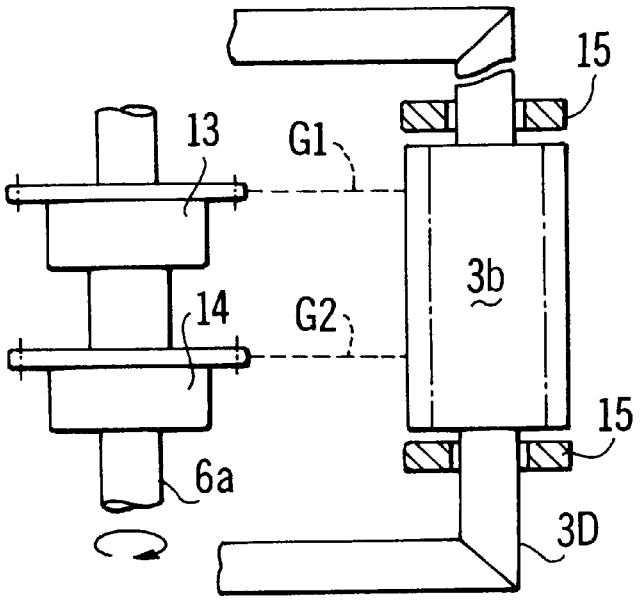
FIG. 11 depicts still another modification of the drive mechanism for moving the upper tray flap.
Figure 12:
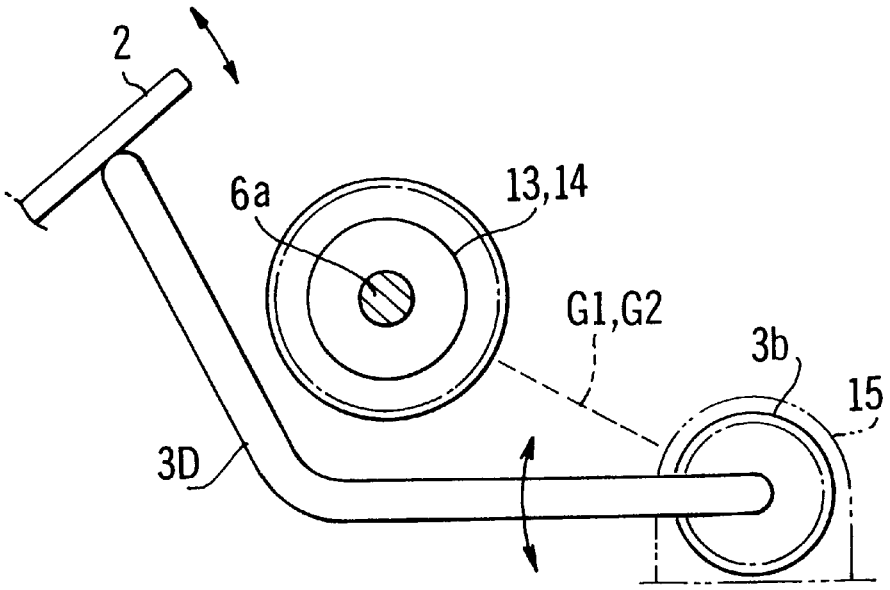
FIG. 12 is a schematic side view of the drive mechanism shown in FIG. 11.

In FIGS. 8 to 10, a drive source (i.e., the motor M) for actuation of the open-close arms 3A, 3B and 3C is separated from the drive source used for movement of the recording paper. FIG. 11 shows an example where the arms obtain the drive power from the drive system of the paper ejection rollers 6 and 7 or the drive system for movement of the recording paper. Electromagnetic clutches 13 and 14 are mounted on a roller shaft 6*a* (that rotates in one direction only) of the paper ejection roller 6. A single open-close arm 3D having a U-shaped configuration as viewed from the above has own pivot center shaft portion which is loosely supported by a pair of boss members 15 and 15. A gear 3*b* is fixed to that axis of rotation between the boss members. The gear 3*b* is selectively engaged with the electromagnetic clutch 13 or 14 via parallel series of gears G1 or G2. There is a difference in the number of gears of the series of gears G1 and G2 which results in reverse rotation of the gear 3*b* since the gear 3*b* is rotated by one of the series of gears G1 and G2. Both of the electromagnetic clutches 13 and 14 are usually separated or disengaged from the roller shaft 6*a* to maintain the flap 2 in position independently of the roller shaft 6*a*. However, when the flap 2 is to be rotated, either of the clutches 13 and 14 engages with the rotor shaft 6*a*. For example, when the clutch 13 is engaged and the clutch 14 disengaged, the gear 3*b* rotates in the same direction as the roller shaft 6*a* via the gear series G1 and thus the open-close arm 3D is made to rotate upwards and the flap 2 is pushed to the "open" position as illustrated in FIG. 12. When the clutch 13 is disengaged and the clutch 14 engaged, on the other hand, the gear 3*b* rotates in the opposite direction to the roller shaft 6*a* via the gear series G2 and thus the open-close arm 3D is made to rotate downwards and the flap 2 returns to the "close" position.

In the arrangements illustrated in FIGS. 2 to 5 and FIGS. 8 to 11, it is necessary to stop the drive unit(s) (the actuators A in FIGS. 2 and 5, the actuators 8 in FIG. 7, the motors M in the case of FIGS. 8 and 9, the electromagnetic solenoids 12 in the case of FIG. 10 and the electromagnetic clutches 13 and 14 in the case of FIG. 11) of the open-close arms 3D at particular positions. For example, stoppage of the rotation of each motor M in the case of FIGS. 8 and 9, stoppage (or switching) of the extension and retraction of the solenoid 12*a* on each electromagnetic solenoid 12 in the case of FIG. 10 and engagement and disengagement of the electromagnetic clutches 13 and 14 in the case of FIG. 11 are required.

Accordingly, in either of the cases, a detection sensor for the stop position is necessary. Instead of detecting the stop position of the drive units for the arms 3 to 3D, the position of the flap 2 may be detected (the flap 2 may be detected when an electromagnetic solenoid 12 is used as in FIG. 10), the position of the rack 3*a* of the open-close arm 3A may be detected in FIG. 8, the rotation position of the cam 11 may be detected in FIG. 9 and the rotation angle of the open-close arm 3D may be detected in FIG. 11. If the paper ejection tray has three or more levels as illustrated in FIG. 6, the number of stop positions to be detected must be three or over to correspond to that. It should be noted that if the paper ejection tray has three levels, detection of the stop positions is only necessary for the upper two levels.

Figure 1:
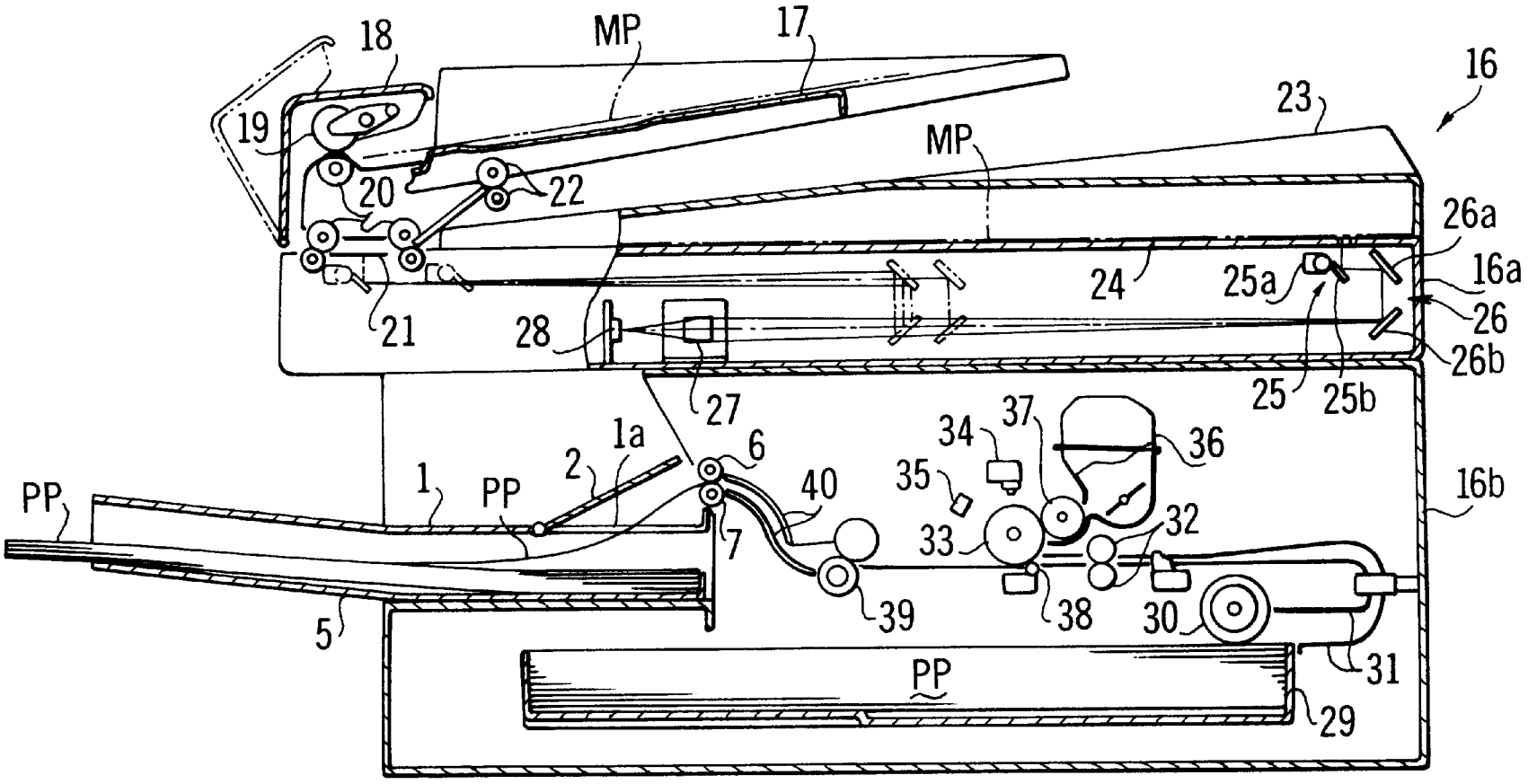
FIG. 1 illustrates an internal side view of an image recording apparatus incorporating an ejected paper sorting device of the present invention.

As described above, when compared to conventional types having an paper ejection tray movement system, the ejected paper sorting device of the present invention has a simple structure and lower costs due to the arrangement of an opening and closing flap 2 and without the movement of the paper ejection tray itself. FIG. 1 shows an embodiment of an ejected paper sorting device comprising two levels (the upper paper ejection tray 1 and the lower paper ejection tray 5) being applied to an image recording machine 16 provided with a copy function and a facsimile function. Since this image recording machine incorporates a simple and inexpensive paper sorting device according to the present invention, a manufacturing cost for the image recording machine is also reduced.

Lastly, a summarized description of the internal structure of the image recording machine shown in FIG. 1 will be given. Furthermore, the method of using the upper paper ejection tray 1 and lower paper ejection tray 5 of the paper sorting device when used in the image recording machine will be described. The image recording machine 16 includes a document scanning part 16*a* formed in its upper portion and a recording part 16*b* formed in its lower portion. The document scanning part 16*a* is a part that scans the document in order to copy it or transmit it to a remote facsimile machine. This part is arranged with a transparent document table 24 on which is rested the document MP to be scanned. Above the document table 24, provided is a document ejection table 23 which is able to open and close. Yet further, a document supply table 17 on which may be stacked a plurality of documents MP is positioned above that at an angle. A document transport guide system 18 having a C-shaped document transport path is positioned between the document supply table 17 and document ejection table 23. The upper portion of the document transport guide system 18 may be opened and closed in order to remove paper blockages etc as indicated by the phantom line. In this document transport guide system 18, a separation roller 19 that picks up the documents MP one page at a time from the documents stacked on the document supply table 17 is positioned on the upstream side of the document transport path, a plurality of paper supply rollers 20, 20 . . . is positioned along the transport path, a transparent light projection plate 21 is positioned under the middle of the transport path and a pair of paper ejection rollers 22 and 22 is positioned at the downstream end of the transport path opposing the document ejection table 23. Due to this structure, the documents MP loaded on the document supply table 17 pass through the document transport guide system 18 one page at a time and are eventually ejected onto the document ejection table 23.

Both a first scanning body 25 provided with a light source 25*a* and a mirror 25*b,* and a second scanning body 26 provided with mirrors 26*a* and 26*b* are positioned below the document table 24 such that they are capable of moving horizontally. A fixed converging lens 27 and a fixed image sensor 28 are also located below the document table 24. Two methods of scanning are possible using these scanning units. One is to hold the document MP stationarily and carry out scanning by moving the scanning units 25 and 26. In short, the scanning is carried out by resting the document in a stationary state on the document table 24 and moving both scanning units (i.e., the first scanning unit 25 and second scanning unit 26) in a horizontal direction below that. Another method involves scanning by holding the scanning units 25 and 26 stationarily and moving the document MP. The documents MP stacked on the document supply table 17 are transported one page at a time along the C-shaped transport path formed by the document transport guide system 18 and in the process of passing over the light projection plate 21 in that transport path, the image on the document is sensed by the first scanning unit 25 positioned below that in a stationary state and scanned into the image sensor 28 via the second scanning unit 26. One of these two scanning methods may be exclusively used in the document scanning for copying and the other method may be exclusively used in the document scanning for facsimile data transmission. It should be noted that the scanning is normally carried out by setting a document on the document supply table 17 but when a thick document is to be scanned, the document may be placed on the document table 24 for scanning.

With either method, the image on the document MP is projected to the image sensor 28 via the converging lens 27 after passing through the first scanning unit 25 and second scanning unit 26. The image sensor 28 converts the image into an electronic signal and sends that signal to a remote facsimile machine in the case of facsimile transmission or sends that signal to a print head or exposing device 34 (described later) in the case of copying.

In the recording part 16*b* of the image recording machine 16, a recording paper supply tray 29 is positioned at the bottom and recording paper PP is stacked in this. The uppermost piece of recording paper PP is picked up one page at a time by a separation roller 30 and transported along a recording paper transportation lane 31. The recording paper PP transported along the recording paper transportation lane 31 is conveyed between a photosensitive drum 33 and a platen roller 38 by a pair of conveyor rollers 32 and 32 and a toner image is eventually developed on a photosensitive drum 33.

Hereafter, a system for developing the toner image on the photosensitive drum 33 will be described. The exposing device 34 positioned near the photosensitive drum 33 receives the image signal of the document MP conveyed by the image sensor 28 in the case of copying and receives the facsimile data signal from a remote facsimile machine in the case of facsimile reception. A light is radiated from the exposing device 34 onto the photosensitive drum 33 based on that received signal. Furthermore, a charge device 35 is positioned in close proximity to the photosensitive drum 33 and an electrostatic latent image based on the light from the exposing device 34 is formed on the photosensitive drum 33. A developer 37 is also positioned next to the photosensitive drum 33 so that a toner filled in a toner box 36 is supplied to the photosensitive drum 33 by the developer 37 to develop the toner image on the photosensitive drum 33.

The toner image on the photosensitive drum 33 is transferred to the recording paper PP which is pressurized by the platen roller 38 against the photosensitive drum 33 and afterwards, the transferred toner image is heat fixed as the recording paper PP passes through a heat fixing device 39. The recording paper PP is then conveyed to a downstream paper ejection lane 40 and ejected into the upper paper ejection tray 1 or lower paper ejection tray 5 by the paper ejection rollers 6 and 7. In FIG. 1, the flap 2 of the upper paper ejection tray 1 has been rotated upwards and the recording paper PP ejected from the paper ejection rollers 6 and 7 is forced to fall into the lower paper ejection tray 5.

Thus, in the image recording machine shown in FIG. 1, there is only one transport path of the recording paper PP and the paper ejection end of the recording machine 16 is only defined by the ejection rollers 6 and 7. Having a single recording paper PP transport path contributes to the overall compactness of the entire recording machine 16. However, because recording upon copying and recording upon facsimile data reception are performed by a single recording paper transport path and a single photosensitive drum 33, the recording manner is the same and it would be difficult for a user to distinguish the recording paper resulting from an copying operation from the recording paper resulting from a facsimile data reception if it were not for a sorting device. The recording machine of the invention comprises a sorting device that sorts the ejected recording paper into the upper paper ejection tray 1 or the lower paper ejection tray 5 according to a selected operation mode, i.e., the facsimile reception mode or copy mode. For example, if the facsimile mode is selected and the recording paper is produced as a result of facsimile reception, the flap 2 closes and the recording paper is ejected into the upper paper ejection tray 1. On the other hand, if the copy mode is selected and the recording paper is produced as a result of copying, the flap 2 rises and the paper is ejected into the lower tray 5. The image recording machine of the invention is adapted to discriminate between the copy mode and facsimile reception mode and control the actuator A that open and closes the open-close arms 3 for opening and closing the flap 2 as shown in FIGS. 2 through 5.

In the above embodiment, the recorded paper is sorted and ejected corresponding to a copy mode or facsimile reception mode, but the teaching of the present invention may be applied to an image recording apparatus such as a printer or facsimile connected to a host computer. In this case, it is possible to distinguish between the data which originally derived from the host computer and the data which originates from an external terminal and it is also feasible to distinguish between the data from the host computer and the data (i.e., copy data and facsimile reception data) from the image recording machine.

As understood from the foregoing, by simply closing and opening the flap 2, it is possible to sort the recording paper into two groups. As compared with a conventional paper sorting device which moves the whole paper tray (which corresponds to the upper tray 1), the structure of the paper sorting device is simplified and the manufacturing cost is reduced.

A drive mechanism for closing and opening the flap is simple in this invention. The flap is only hinge-linked to the upper paper tray 1 and pushed up and down. This also contributes to a decrease in costs. The weight of the flap 2 is also light.

The image recording machine incorporating such a paper sorting device is also manufactured with a reduced cost.

A user is easily able to distinguish the recording paper which is ejected upon copying from the recording paper which is ejected upon facsimile date reception, by drawing a particular paper tray.

What is claimed is:

1. A paper sorting device incorporated in a recording machine comprising:

a first tray for paper located near a recording exit of said recording machine;

a second tray for paper located below said first tray for paper;

a first flap which is a part of said first tray for paper and is movable for forming a first opening for passing recording paper therethrough; and first drive means for maintaining said first flap in position and moving said first flap for forming said first opening.

2. The paper sorting device as recited in claim 1, wherein said first flap is hinge-linked to said first tray for paper so that said first flap can rotate upward and downward about said hinge-link.

3. The paper sorting device as recited in claim 1, wherein said recording machine is an image recording machine having a facsimile function and a copy function, and recording paper resulting from facsimile data reception from a remote facsimile is ejected onto said first tray for paper and a recording paper resulting from copying is ejected onto said second tray for paper.

4. The paper sorting device as recited in claim 3 further including means for determining whether said recording machine is operated in a facsimile mode or a copy mode and wherein said first flap is maintained in position when said recording machine is determined to be in said facsimile mode and said first flap is moved for forming said first opening when said recording machine is determined to be in said copy mode.

5. The paper sorting device as recited in claim 1 further including means for determining an operation mode of said recording machine and said first flap is moved to form said first opening depending upon said determined operation mode of said recording machine.

6. The paper sorting device as recited in claim 1 further including:

a third tray for paper located below said second tray for paper;

a second flap which is a part of said second tray for paper and movable for forming a second opening for passing of said recording paper therethrough; and second drive means for maintaining said second flap in position and forming said second opening.

7. The paper sorting device as recited in claim 6, wherein said second flap is hinge-linked to said second tray for paper so that said second flap can rotate about its hinge upwards and downwards.

8. The paper sorting device as recited in claim 1, further including:

an intermediate tray for paper located between said first and second trays for paper;

a second flap which is a part of said intermediate tray for paper and which is able to move and form a second opening for passing said recording paper therethrough; and second drive means for maintaining said second flap in position or moving said second flap and forming said second opening.

9. The paper sorting device as recited in claim 8, wherein said second flap is hinge-linked to said intermediate tray for paper so that said second flap can rotate about its hinge upwards and downwards.

10. The sorting paper device as recited in claim 1, wherein said second tray for paper has a plurality of sections thereon for reception of different recording paper respectively, and said paper sorting device further includes means for sliding said second tray horizontally so that different sections of said second tray for paper can be used for reception of said different recording paper.

11. The paper sorting device as recited in claim 1, wherein a width of said first opening is slightly larger than a width of an ejected recording paper.

12. The paper sorting device as recited in claim 6, wherein a width of said second opening is slightly larger that a width of an ejected recording paper.

13. The paper sorting device as recited in claim 8, wherein a width of said second opening is slightly larger than a width of an ejected recording paper.

* * * * *